United States Patent [19]

Nicholls et al.

[11] 4,042,242

[45] Aug. 16, 1977

[54] RESILIENTLY MOUNTED TARGETS ROTATED BY ESCAPEMENT DEVICE

[75] Inventors: Bryan Frederick Nicholls; Peter John Marshall, both of Northants, England

[73] Assignee: The Mettoy Company Limited, Northampton, England

[21] Appl. No.: 622,380

[22] Filed: Oct. 14, 1975

[51] Int. Cl.[2] ..... F41J 9/02

[52] U.S. Cl. ..... 273/105.2; 185/31; 273/102 AP

[58] Field of Search ..... 273/102.1 R, 102.1 C, 273/101, 105.2, 102 R, 102 AP, 102.1 E, 127 D, 41; 74/1.5; 58/116 R, 46 R, 123, 124, 129; 185/31

[56] References Cited

U.S. PATENT DOCUMENTS

| | | | |
|---|---|---|---|
| 61,179 | 1/1867 | Eckert | 185/31 |
| 142,081 | 8/1873 | Bash | 185/31 |
| 402,823 | 5/1889 | Hammer | 58/116 R |
| 884,663 | 4/1908 | Johnston | 273/102 E |
| 1,540,802 | 6/1925 | Ordway | 273/105.2 |
| 2,232,743 | 2/1941 | Swenson | 273/105.2 |
| 2,445,844 | 7/1948 | Wallach | 273/105.2 |
| 3,439,545 | 4/1969 | Siot | 74/1.5 |
| 3,503,614 | 3/1970 | Suroff | 273/105.2 |
| 3,814,429 | 6/1974 | Lienhard | 273/105.2 |
| 3,844,559 | 10/1974 | Davidson | 273/102.1 E |

*Primary Examiner*—Richard C. Pinkham
*Assistant Examiner*—Lawrence E. Anderson
*Attorney, Agent, or Firm*—Brisebois & Kruger

[57] ABSTRACT

In a toy target, target figures are rotated about a horizontal axis at a controlled speed by a gravitationally driven escapement mechanism. The figures are carried by wire elements for pivotal movement between "upright" and "knocked down" positions, and devices which attach the figures to the elements are arranged to return the figures automatically to their upright positions after they have been knocked down.

4 Claims, 9 Drawing Figures

RESILIENTLY MOUNTED TARGETS ROTATED BY ESCAPEMENT DEVICE

This invention relates to a toy moving target for use with toy guns which project missiles.

In the past, toy targets have frequently included moving figures, for example in the shape of birds, which are driven by spring mechanisms or electric motors. However, spring drive mechanisms tend to be complicated and electrical motors are expensive in the use of batteries and often unsuitable for outdoor use.

There is also known a target in which the figures are rotated about a vertical axis by mounting the figures on a horizontal bar secured to the top of a helically twisted steel strip which is journalled in upper and lower bearings. A weight which is held against rotation is located on the strip, so that when the weight is released from an upper position, it slides down the strip causing the latter, and hence the bar carrying the figures, to rotate. This drive mechanism does not allow for rotation of the target figures about a generally horizontal axis without the use of gearing.

Furthermore, in these known target constructions the figures have to be reset manually after having been knocked down by a missile.

In accordance with the invention there is provided a toy target comprising a target figure supported for rotation about a generally horizontal axis remote from the figure and a gravitationally driven escapement mechanism in driving engagement with the figure for rotating the figure about the axis at a controlled speed.

In a preferred embodiment the figure is pivotally mounted on a wire support by a spring member of unitary construction so arranged that when the figure is pivoted about the wire support (for example, as a result of being struck by a missile) it will return automatically to the initial, upright position.

The presently preferred embodiment of the invention is described below by way of example with reference to the accompanying drawings, in which.

Figure 4:
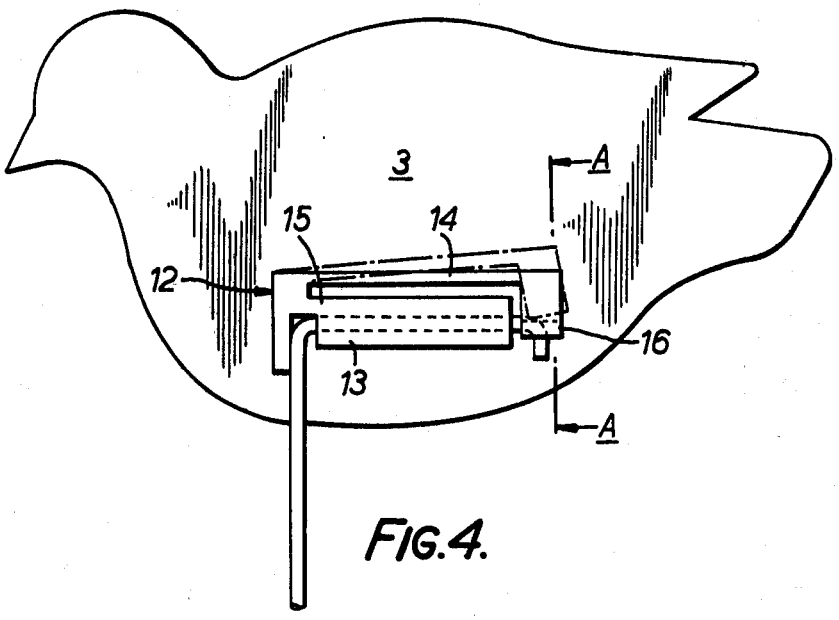
FIG. 4 is a view showing how a figure is mounted on the wire support.
Figure 5A:
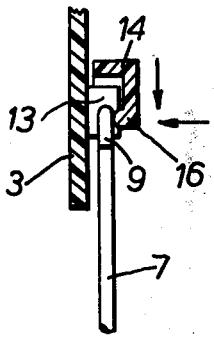
Figure 5B:
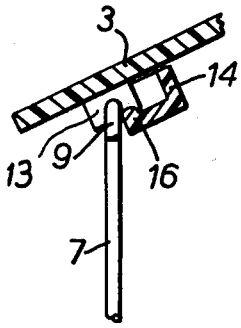
Figure 5C:
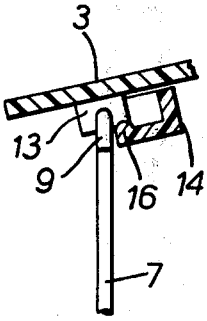
Figure 6:
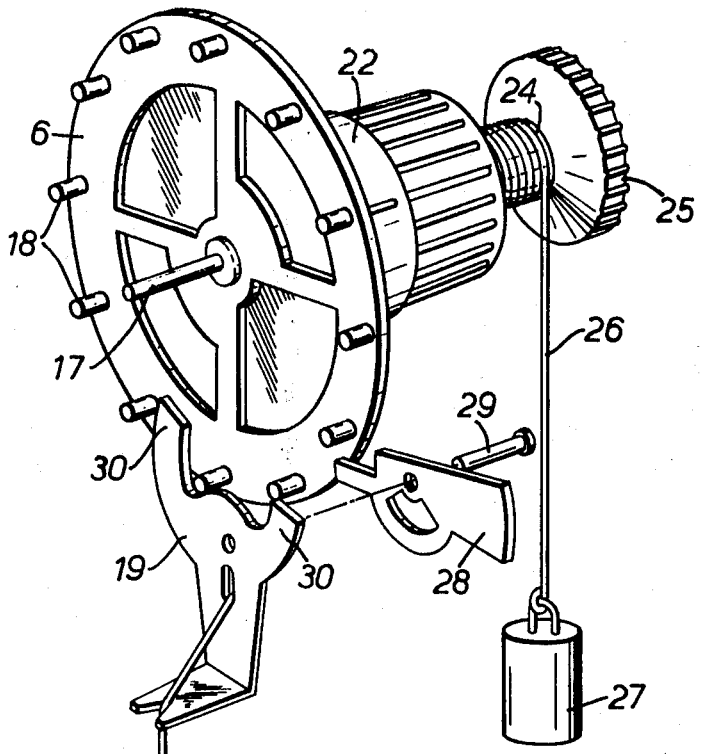
Figure 7:
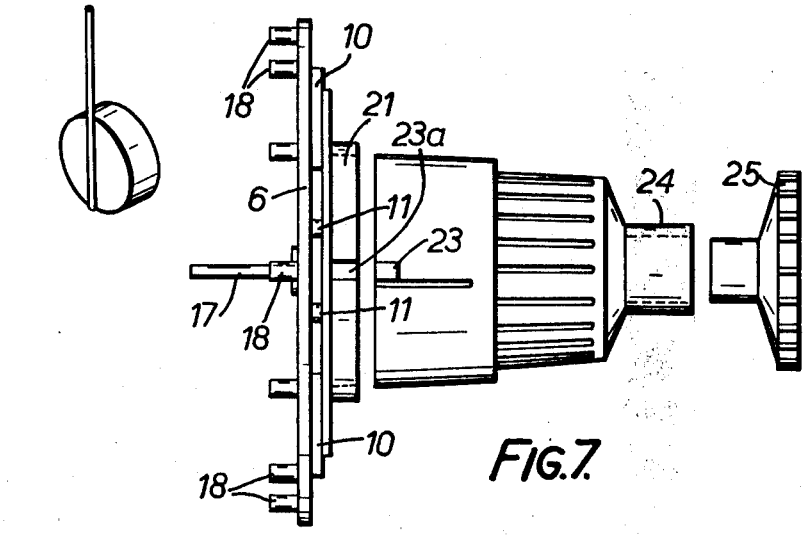

FIGS. 5*a*, 5*b* and 5*c* are fragmentary sections taken along the line A—A of FIG. 4 with the figure in different pivotal positions relative to the support;

FIG. 6 is a perspective view showing the escapement drive mechanism for the figures; and FIG. 7 is a side elevational view showing the escapement wheel and winding mechanism.

The target comprises a circular board 1 rigidly mounted upon a tripod arrangement which is hidden by the board 1 and target base portion 2. Four target figures 3 having the shape of birds are mounted behind the board 1 for rotation about an axis generally parallel with, but eccentric to, the board axis such that the figures, when viewed from the front, will appear and then disappear again as they rotate.

Figure 1:
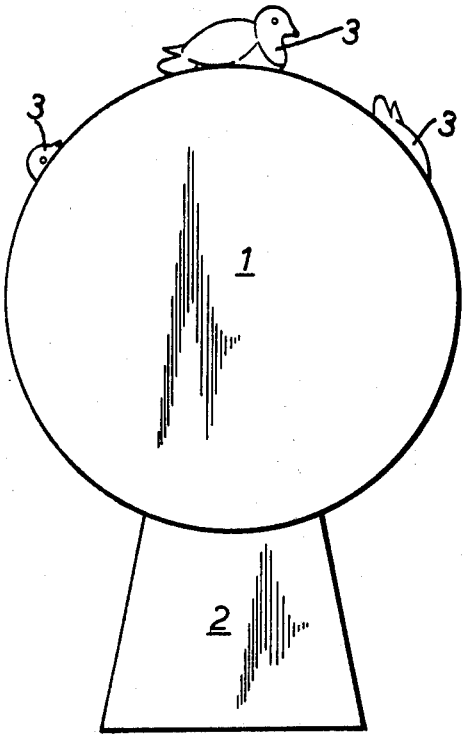
FIG. 1 is a front elevational view of a target.
Figure 2:
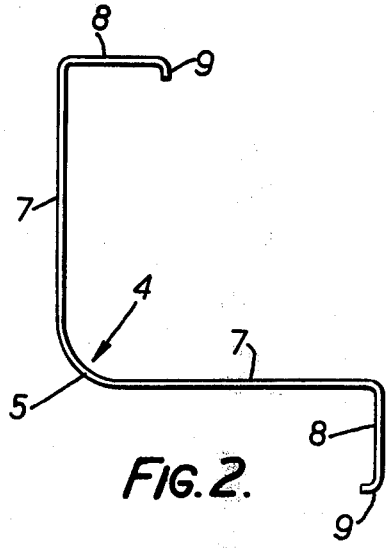
FIG. 2 shows a wire support for the target figures.
Figure 3:
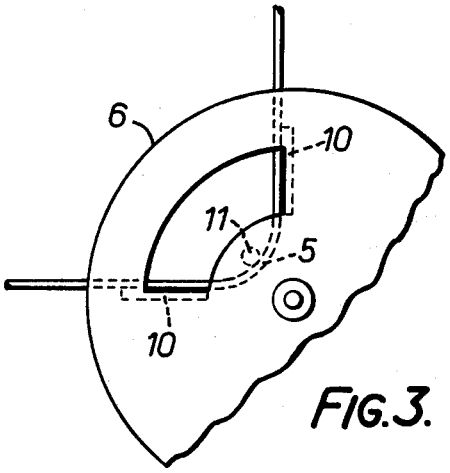
FIG. 3 is an elevational view illustrating the attachment of the wire support to an escapement wheel.

Each bird-like FIG. 3 is pivotally mounted on the end of a wire support 4, two such supports being provided and each carrying a bird at either end thereof. Each support 4 has a curved medial portion 5 for attachment to an escapement wheel 6, two arms 7 extending in mutually perpendicular directions from the medial portion, each arm being bent at right angles towards its outer end to form support portions 8, and finally short end portions 9 which extend parallel to the respective arms 7. The supports are frictionally mounted on the escapement wheel 6 by the arms engaging radially extending abutments 10 on the rear of the wheel while the curved portion 5 snaps over a dimple 11 also on the back of the wheel. The attachment of only one support is illustrated in FIG. 3, but the second support 4 is attached in identical fashion to the wheel in the quadrant diametrically opposite the first support.

A bird-like FIG. 3 is secured on each end of the wire support by an integrally moulded spring clip 12 which has part 13 connected to a second part 14 through a resilient portion 15. The first part 13 is adapted to be secured to the FIG. 3, such as by a screw, with the wire support 8 being held between the figure and spring part 13, so that the figure can pivot about the wire. An abutment 16 at the free end of second spring part 14 engages the free end portion 9 of the wire support from the side opposite the FIG. 3 when the latter is in its upright position, shown in FIGS. 4 and 5. If the target is struck, for example by a toy missile to pivot the figure about the wire, such as to a position, as shown in FIG. 5*b* or 5*c*, the end wire portion 9 flexes the second spring part 14 away from the first part 13 (as illustrated in broken line in FIG. 4). A return force is generated by the resilient portion 15 biasing the two spring portions back together to move the target back to its upright position by the abutment 16 bearing on wire end 9. The pivotal movement of the FIG. 3 relative to the wire is limited by the arm 7 engaging spring portion 15, thereby ensuring that the figure will always be returned automatically to its upright position after being knocked over.

The mechanism for rotatably driving the bird-like FIG. 3 is shown in FIGS. 6 and 7 and includes escapement wheel 6 to which the figure supports are attached as described earlier. The escapement wheel 6 is rotatably mounted on a spindle 17 which is secured to the board and may conveniently be formed integrally with the board support structure. There are twelve uniformly, circumferentially spaced, forwardly projecting pegs 18 on the wheel which co-operate with a pawl lever 19 from which a pendulum 20 is suspended. A rearwardly directed short annular sleeve 21 (FIG. 7) is provided on the escapement wheel for receiving an end of an axially movable central drum 22 of a driving and winding unit, the drum also being rotatable on the 17. A radial pawl 23 enters an axial slot 23a in the sleeve 21 when the drum and sleeve are brought together to ensure rotation of the wheel with the drum. The driving and winding unit has a spool 24 and winding knob 25 for winding a flexible cord 26 suspending a driving weight 27 onto the spool when the drum 22 is moved out of rotational engagement with the wheel 6. The pawl lever 19 and a jockey plate 28 are mounted on a pivot 29 which may also be secured to the support structure for the board 1. The pawls 30 of lever 19 co-operate with the pegs to govern the speed of rotation of the wheel caused by unwinding of the cord 26 from spool 24, in the well known fashion of an escapement. The jockey plate serves to lock behind the pegs to prevent them rebounding from the pawl faces and upsetting the operation of the escapement.

Thus, when the weight cord has been wound up, as described, and the pawl 23 engaged in slot 24, the winding unit may be manually released so that the wheel 6 and hence the bird-like figures rotate at a rate controlled by the escapement. Rotation will stop when the cord 26 is fully unwound. Preferably the unwinding time should give a user sufficient time to retreat to a firing position and attempt to shoot down the figures before the latter stop moving.

We claim:

1. A toy target comprising a target figure, a support structure supporting said figure for rotation about a horizontal axis remote from said figure, and drive means for rotating said figure about said axis at a controlled speed, said support structure comprising a wire element on which said figure is supported for pivotal movement between an upright position and a knocked down position, and return means for returning said figure automatically to said upright position after it has been moved into said knocked down position, said return means including a spring member comprising a first part rigidly connected to said figure to retain said figure on said wire element and a second part resiliently connected to said first part and arranged to produce a return force on said figure to pivot the figure to said upright position when said figure is knocked down, said drive means further comprising a gravitationally driven escapement mechanism in driving relationship with said figure, said escapement mechanism comprising an escapement wheel mounted for rotation about said axis and having a plurality of circumferentially spaced projections, and a pawl lever pivotally mounted beneath said wheel for cooperation with said projections and having a pendulum rigidly suspended therefrom, a winding drum being mounted for rotation about said axis, and a flexible cord being wound upon said drum and suspending a driving weight, said drum being axially movable between a first position in which it is keyed for rotation with said wheel, whereby the escapement controls unwinding of said cord from said drum under the influence of said weight, and a second position in which said drum is free to rotate relative to said wheel for winding up said cord onto said drum.

2. A toy target according to claim 1, wherein a jockey plate is rotatably mounted on the pawl lever pivot and arranged to prevent said projections rebounding from said pawl lever during operation of the escapement.

3. A toy target according to claim 1, wherein said spring member comprises a first part rigidly connected to said figure for retaining said figure on said element, and a second part resiliently connected to said first part and arranged to co-operate with said support element in such a manner that pivotal movement of said figure away from its said upright position causes said second part to be resiliently deflected by said support away from a neutral position relative to said first part to create a return force acting between said figure and support element in a sense to return said figure to its upright position.

4. A toy target according to claim 1 wherein a stationary screen is provided and said figure is arranged to rotate behind said screen in such a manner that the figure appears and disappears from view as it rotates.

* * * * *